US008351806B2

(12) United States Patent
Niijima

(10) Patent No.: US 8,351,806 B2
(45) Date of Patent: Jan. 8, 2013

(54) IMAGE FORMING APPARATUS WITH DENSITY DETECTION

(75) Inventor: Yoshio Niijima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 286 days.

(21) Appl. No.: 12/830,809

(22) Filed: Jul. 6, 2010

(65) Prior Publication Data

US 2011/0002702 A1 Jan. 6, 2011

(30) Foreign Application Priority Data

Jul. 6, 2009 (JP) ..... 2009-159519

(51) Int. Cl.
*G03G 15/00* (2006.01)

(52) U.S. Cl. ..... 399/44; 399/49

(58) Field of Classification Search ..... 399/38, 399/44, 49, 53–56
See application file for complete search history.

(56) References Cited

U.S. PATENT DOCUMENTS

| | | | | |
|---|---|---|---|---|
| 5,697,012 | A * | 12/1997 | Sasanuma et al. | 399/49 |
| 5,970,276 | A * | 10/1999 | Kato | 399/29 |
| 6,385,408 | B1 * | 5/2002 | Scheuer | 399/49 |
| 7,949,267 | B2 * | 5/2011 | Nakasha | 399/44 |

FOREIGN PATENT DOCUMENTS

| | | | |
|---|---|---|---|
| JP | 2004-341100 | A | 12/2004 |
| JP | 2006-003555 | A | 1/2006 |
| JP | 2007-147782 | A | 6/2007 |
| JP | 2007-322716 | A | 12/2007 |
| JP | 2009-042533 | A | 2/2009 |

* cited by examiner

*Primary Examiner* — Hoan Tran
(74) *Attorney, Agent, or Firm* — Marvin A. Motsenbocker; Mots Law, PLLC

(57) ABSTRACT

An image forming apparatus includes: a developer image carrier movably disposed; a developer image forming device configured to form a developer image; a detector configured to detect a density of the developer image formed on the developer image carrier; a controller configured to control an operation of forming of the developer image by the developer image forming device; an image forming unit configured to control the developer image forming device to form a density detection pattern including the same developer images at at least a first point and a second point with a predetermined distance therebetween; a density detector configured to obtain the density of the first point and the density of the second point of the density detection pattern via the detector; and a calculator configured to calculate a density difference between the first point and the second point based on the densities obtained by the density detector.

20 Claims, 10 Drawing Sheets

SMEAR DETECTION PATTERN 1

<WHEN THERE IS A SMEAR>

<WHEN THERE IS NO SMEAR>

IMAGE FORMING APPARATUS WITH DENSITY DETECTION

CROSS REFERENCE TO RELATED APPLICATIONS

This application claims priority based on 35 USC 119 from prior Japanese Patent Application No. P2009-159519 filed on Jul. 6, 2009, entitled "image forming apparatus", the entire contents of which are incorporated herein by reference.

BACKGROUND OF THE INVENTION

1. Field of the Invention

The invention relates to an image forming apparatus.

2. Description of Related Art

Since print density (thickness) using toner serving as developer may vary from thick to thin due to environmental or temporal changes, a conventional image forming apparatus such as an electrophotographic printer or a copier detects the density of printing with a densitometer and executes a density correction in order to maintain the print density constant. For example, Japanese Patent Application Laid-Open No. 2004-341100 discloses a technique capable of high-quality printing by compensating for the sensitivity of a densitometer.

In a conventional image forming apparatus, when the toner take-out is continuously low, most of the toner spends more time on the developing roller and thus may become triboelectrifically charged to an excessive level. When such excessively charged toner is transferred to an electrostatic latent image on the photosensitive drum, the excessively charged toner is attached to the photosensitive drum more than necessary. This causes excessively high density portions, that is, smears on the printed paper sheet.

SUMMARY OF THE INVENTION

A first aspect of the invention is an image forming apparatus including: a developer image carrier movably disposed; a developer image forming device configured to form a developer image; a detector disposed facing the developer image carrier and configured to detect a density of the developer image attached on the developer image carrier; a controller configured to control an operation of forming the developer image by the developer image forming device; an image forming unit configured to control the developer image forming device to form a density detection pattern comprised of the developer image, wherein the density detection pattern includes the same developer images at at least a first point and a second point with a predetermined distance between the first point and the second point; a density detector configured to obtain a first point density and a second point density of the density detection pattern; and a calculator configured to calculate a difference between the first point density and the second point density of the density detection pattern.

According to the first aspect of the invention, the image forming apparatus may determine whether smear occurs on the density detection pattern based on the calculated density difference and may discard developer that causes smear on print media based on the determination result.

A second aspect of the invention is an image forming apparatus including: the first aspect; and an environment detector configured to detect temperature and humidity, wherein the controller changes, based on the detection result of the environment detector, a timing for determining the developer charge level.

According to the second aspect of the invention, the image forming apparatus can change frequency of executing a smear detecting operation based on the detected temperature and humidity detected by the environment detector. Therefore, the image forming apparatus of the second aspect can eliminate an unnecessary smear detecting operation.

A third aspect of the invention is an image forming apparatus including: an image carrier disposed to be movable; a latent image forming unit configured to form dots forming an electrostatic latent image on the image carrier; a developer image forming unit configured to charge developer and develop the electrostatic latent image on the image carrier with the charged developer; a controller configured to control the developer image forming unit to form the developer image; a dot number counter configured to count the number of the dots of the electrostatic latent image formed by the developer image forming unit; an image carrier rotation amount measuring unit configured to measure a rotation amount of the image carrier; a printed media counter configured to count the number of the printed media; and a print ratio calculator configured to calculate a print ratio based on an average of the number of the dots of the electrostatic latent image per unit of print media, wherein the controller configured to change, based on the print ratio and the number of the printed media, a timing for determining a developer charge level.

According to the third aspect of the invention, the image forming apparatus can change frequency of executing a smear detection operation, thereby eliminate an unnecessary smear detection operation.

DETAILED DESCRIPTION OF EMBODIMENTS

Figure 1:
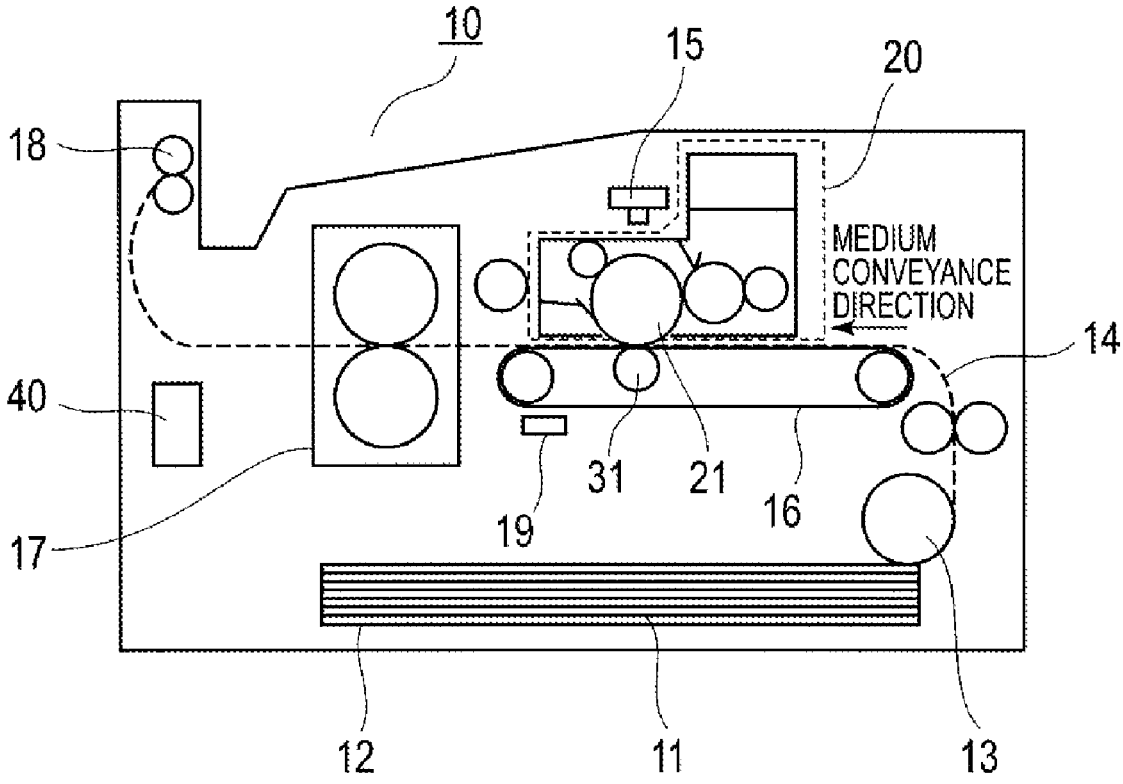
FIG. 1 is a configuration diagram of an image forming apparatus of a first embodiment of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

Configuration of Image Forming Apparatus of First Embodiment

FIG. 1 is the configuration diagram of the image forming apparatus of the first embodiment of the invention.

Image forming apparatus 10 of the first embodiment of the invention is, for example, an electrophotographic printer. Image forming apparatus includes: cassette 12 that contains therein print media such as paper sheets 11; pick-up roller 13 configured to feed paper sheets 11 consecutively to conveyance path 14; exposure head 15 and image forming cartridge 20 configured to form a developer image such as a toner image; and image transfer belt 16 configured to convey paper sheets 11 to image forming cartridge 20 along conveyance path 14. Note that image transfer belt 16 normally functions to convey paper sheet 11 through image forming cartridge 20 along conveyance path 14 such that a developer image (a toner image) is transferred onto paper sheet 11. But image transfer belt 16 also functions as a developer image carrier (a toner image carrier) on which the toner image is transferred, since the toner image can be transferred from image forming cartridge 20 to transfer belt 16 when image transfer belt 16 conveys no paper sheet 11.

Further, image forming apparatus 10 includes: fixing device 17 configured to fix the toner image to paper sheet 11 with heat; discharging rollers 18 configured to discharge paper sheet 11 containing the fixed image out of image forming apparatus 10, a detector such as density sensor 19 configured to detect the density of the toner image formed on image transfer belt 16; and controller 40 including various functional blocks and operable to control the overall image forming apparatus. Density sensor 19 is, for example, an optical sensor of reflective type and functions to radiate light onto the toner image on image transfer belt 16 and to detect the amount of reflection thereof.

Figure 2:
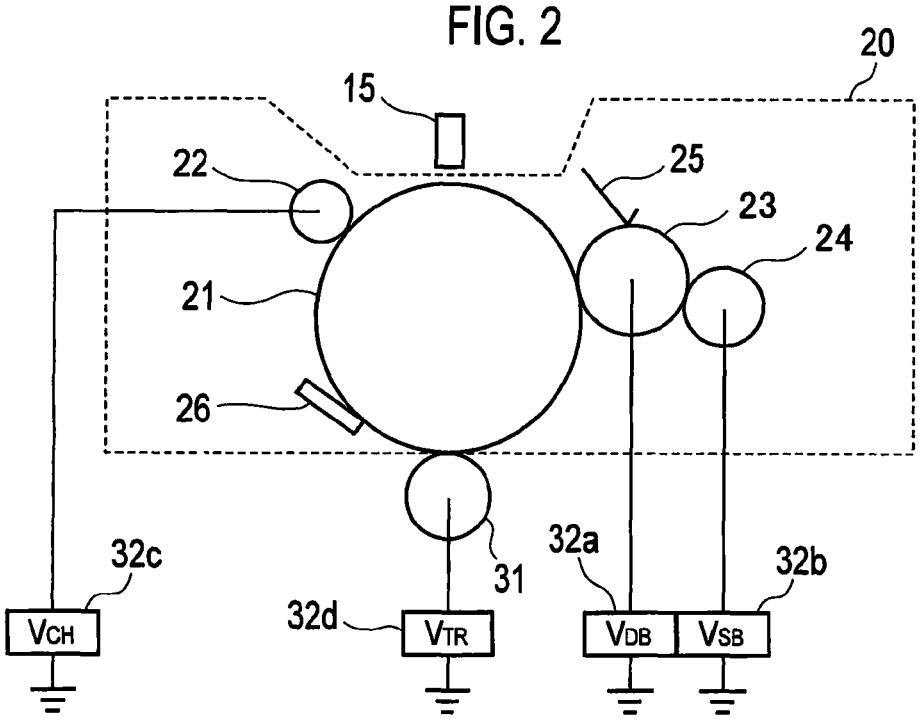
FIG. 2 is a configuration diagram of image forming cartridge 20 shown in FIG. 1.

FIG. 2 is a configuration diagram of image forming cartridge 20 shown in FIG. 1. Image forming cartridge 20 functions as a developer image forming device. Image forming cartridge 20 includes the developer image carrier 21, such as a photosensitive drum, on whose surface a latent image is formed; charging roller 22 configured to uniformly charge the surface of photosensitive drum 21; developing roller 23 being in contact with the surface of photosensitive drum 21 and configured to attach toner to the latent image on photosensitive drum 21 when energized; supplying roller 24 configured to supply toner to developing roller 23; toner regulating member 25 disposed in contact with developing roller 23 and configured to form a developer layer such as a toner layer on the surface of developing roller 23; and cleaning unit 26 disposed in contact with photosensitive drum 21 to remove toner and/or paper debris from the surface of photosensitive drum 21. Developing roller 23, supplying roller 24, and toner regulating member 25 constitute a developing unit to form a developer layer.

Disposed around image forming cartridge 20 are: exposure head 15 using LEDs, a laser, or the like and configured to emit dotted light thereby forming an electrostatic latent image comprised of dots on photosensitive drum 21; image transfer roller 31 configured to, upon being energized, generate an electric field to transfer the toner image from the surface of photosensitive drum 21 onto paper sheet 11; and various power sources 32 (32*a* to 32*d*).

Photosensitive drum 21 includes a conductive support and a photosensitive layer. More specifically, photosensitive drum 21 is an organic photoreceptor including: the conductive support made of an aluminum pipe; and the photoconductive layer formed on the aluminum pipe and having a charge generation layer and a charge transport layer which are sequentially stacked. Each of charging roller 22, developing roller 23, and image transfer roller 31 is formed from a metal shaft with a semiconducting rubber layer on the metal shaft. Supplying roller 24 is formed from a metal shaft with a foamed urethane rubber member or the like on the metal shaft and functions to supply toner to developing roller 23. Toner regulating member 25 is a thin plate with, for example, a thickness of 0.08 mm and a length in the longitudinal direction being substantially the same as the width of the elastic body of developing roller 23. Toner regulating member 25 is disposed such that one end in the widthwise direction is fixed to an unillustrated frame and the other end comes in contact with developing roller 23 on a surface slightly inside from the other end.

Figure 3:
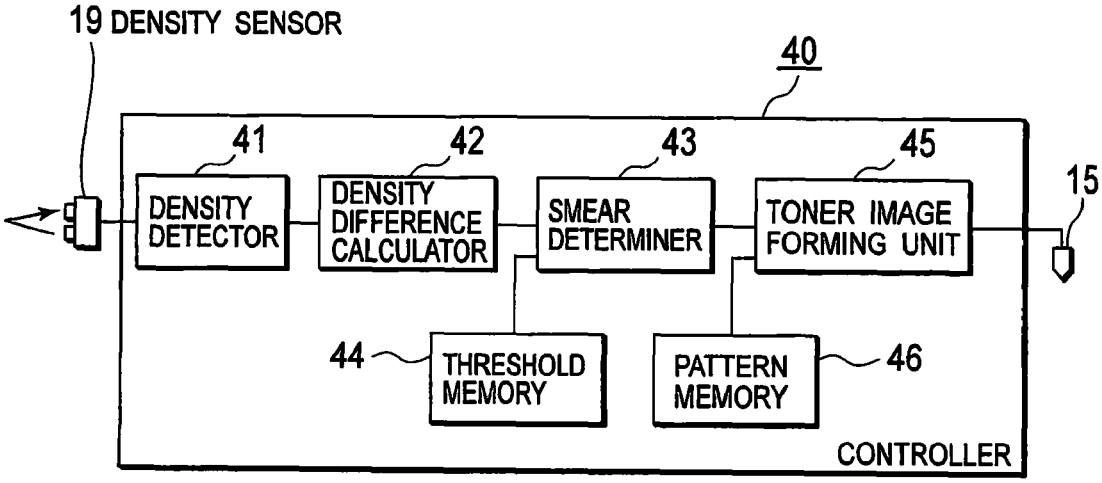
FIG. 3 is a functional block diagram of controller 40 shown in FIG. 1 of the first embodiment of the invention.

FIG. 3 is a functional block diagram of controller 40 shown in FIG. 1 of the first embodiment of the invention.

Controller 40 includes density detector 41 configured to detect the toner density of the density detection pattern comprised of the developer image (for example, a smear detection pattern) on image transfer belt 16 using density sensor 19 which is a reflective optical sensor, a calculator (for example, density-difference calculator 42) configured to calculate the difference between densities of plural positions of the smear detection pattern that are detected by density detector 41, smear determiner 43 configured to determine whether or not the density-difference calculated by density-difference calculator 42 is equal to or greater than a predetermined threshold that is stored in threshold memory 44, and an image forming unit (for example, toner image forming unit 45) configured to control the developer image forming device to form a predetermined smear detection pattern stored in pattern memory 46 on photosensitive drum 21 on the basis of the result of smear determiner 43.

(Mechanism of Occurrence of Smear)

Figure 4A:
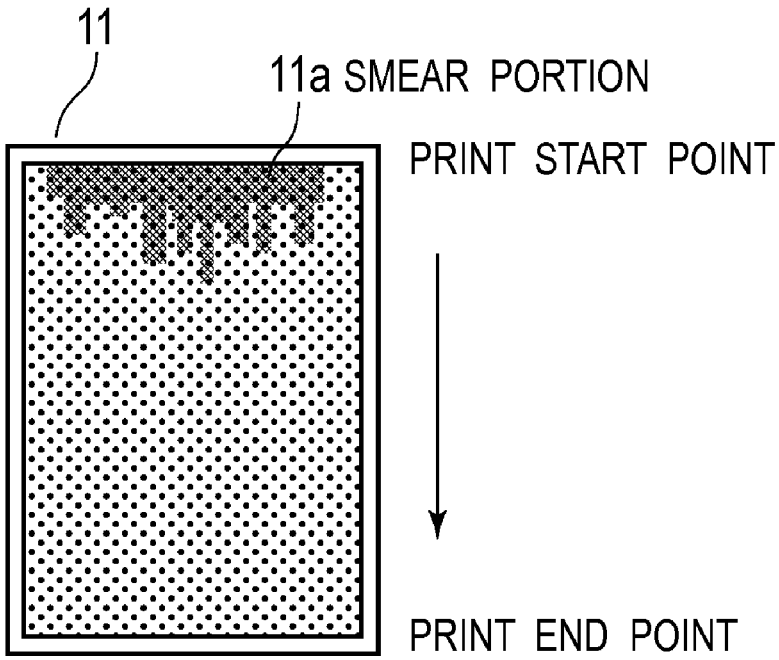
FIGS. 4A and 4B are explanatory views illustrating a condition where a smear occurs on paper sheet 11 shown in FIG. 1.

FIGS. 4A and 48 are explanatory views illustrating a condition where a smear occurs on paper sheet 11 shown in FIG. 1.

The smear on printed sheet(s) 11 occurs by the following mechanism. If some toner attached on developing roller 23 continues to not be attracted to photosensitive drum 21 while continuing to rotate with developing roller 23, such toner continues to be rubbed, for example, between developing roller 23 and supplying roller 24 and thus may be triboelectrifically charged to an excessive level. Upon development of the latent image on photosensitive drum 21, the excessively-charged toner on developing roller 23 may be excessively attracted and attached to photosensitive drum 11, thereby forming an excessively high density portion (a smear portion) on paper sheet 11.

Figure 4B:
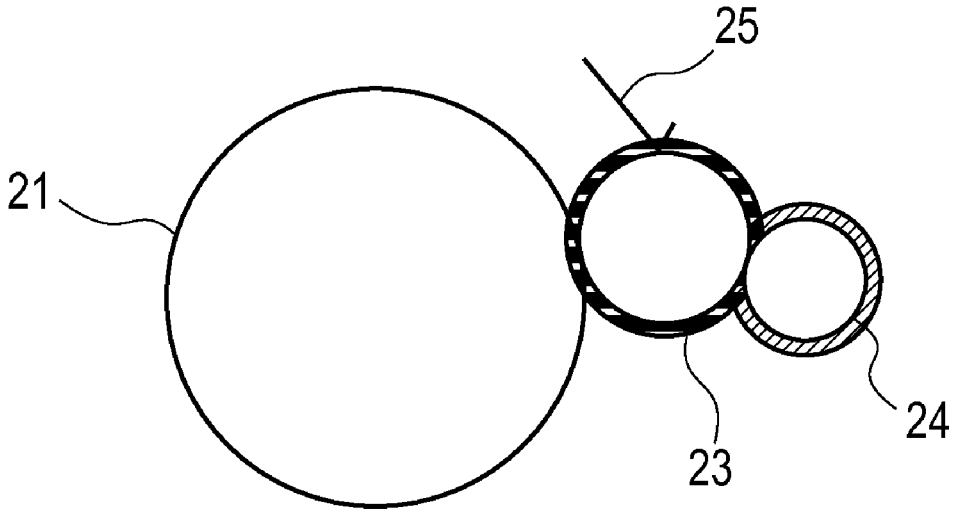

Smear portion 11*a* frequently occurs around the print start point as shown in FIG. 4A. This is because, as shown in FIG. 4B, the excessively charged toner on developing roller 23 is supplied to photosensitive drum 21 as toner for printing, at the beginning of the developing process. Therefore, in the vicinity of the printing start point on paper sheet 11, smear portion 11*a* occurs. After that (after the excessive charged toner is supplied from supplying roller 24 to photosensitive drum 21), fresh toner (normally-charged toner) is now supplied to developing roller 23 from supplying roller 24, and the image is printed with normal density on paper sheet 11.

Places where toner is triboelectrifically charged are mainly three points including contact between developing roller 23 and toner regulating member 25, contact between developing roller 23 and photosensitive drum 21, and contact between developing roller 23 and supplying roller 24. All three contact points where the excessively charged toner may be generated are on the outer circumferential surface of developing roller 23, whereas the entire circumferential surface of developing roller 23 tends to be covered with the fresh toner because supplying roller 24 functions to keep supplying the fresh toner to developing roller 23. That is, the excessively charged toner tends to exist on the circumferential surface of developing roller 23 and thus tends to be charged more. If a large amount of the excessively charged toner is generated on developing roller 23, some of the excessively charged toner moves to supplying roller 24 and thus may exist on supplying roller 24.

For those reasons, smear tends to appear on paper sheet(s) 11 only in the range of one rotation of developing roller 23 from the print start point or only in a range defined by the total length of one rotation of supplying roller 24 and one rotation of developing roller 23. After those ranges, printed image density tends to be normal.

The first embodiment focuses on smear around the print start point and prevents it. That is, the first embodiment considers the range of one rotation of developing roller 23 as the area where smear occurs. However, the invention is not limited to this and thus does not exclude the idea that smear occurs in the range defined by the total length of one rotation of developing roller 23 and one rotation of supplying roller 24 or that smear occurs in a range of one rotation of supplying roller 24.

Regarding the relationship between the density of a print image and the likelihood of the occurrence of smear, the smear tends to appear more on paper sheet(s) 11 when the print image density is low. In contrast, smear rarely appears on paper sheet(s) 11 when the print image density is high. This is because the amount of toner used for printing influences the likelihood of the occurrence of smear. In other words, in high density printing, the toner is discharged from developing roller 23 to photosensitive drum 21 and paper sheet(s) 11 as printed toner, before being excessively charged on developing roller 23.

(Configuration of Smear Detection Pattern)

Considering the above, the first embodiment executes a smear detecting operation (also referred to as an abnormal charge detecting operation or an excessively-charged toner detecting operation). Specifically, the first embodiment develops a smear detection pattern (serving as a density detection pattern comprised of developer image), which comprises a low density toner image pattern (a half-tone pattern), on image transfer belt 16, detects the toner density of the smear detection pattern at a first position and detects a toner density of the smear detection pattern at a second position by using density sensor 19, calculates the difference between the toner density at the first position and the toner density at the second position, and detects whether or not smear due to excessively charged toner occurs on image transfer belt 16. The first position is the leading area of the smear detection pattern, and the second position is located away from the leading area of the smear detection pattern by a predetermined length that is equal to or greater than the length of one rotation of developing roller 23. Note that, the timing of when the smear detecting operation (the excessively-charged toner detecting operation) is executed depends on characteristics of the apparatus. For example, the smear detecting operation (the excessively-charged toner detecting operation) may be executed every time that a predetermined number of sheets have been printed, may be executed every predetermined operating time, or may be executed every time that printing starts.

Figure 5A:
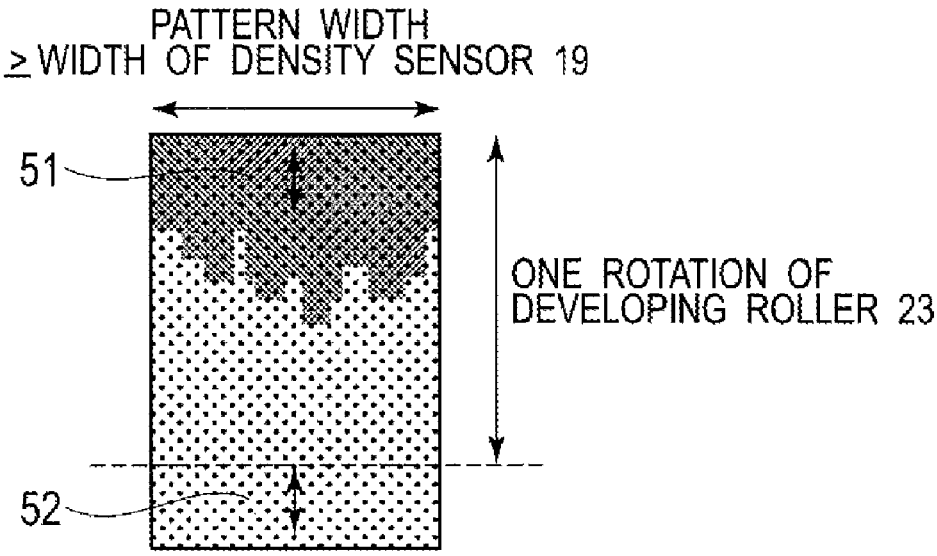
FIGS. 5A and 5B are explanatory views illustrating smear detection pattern 1.
Figure 5B:
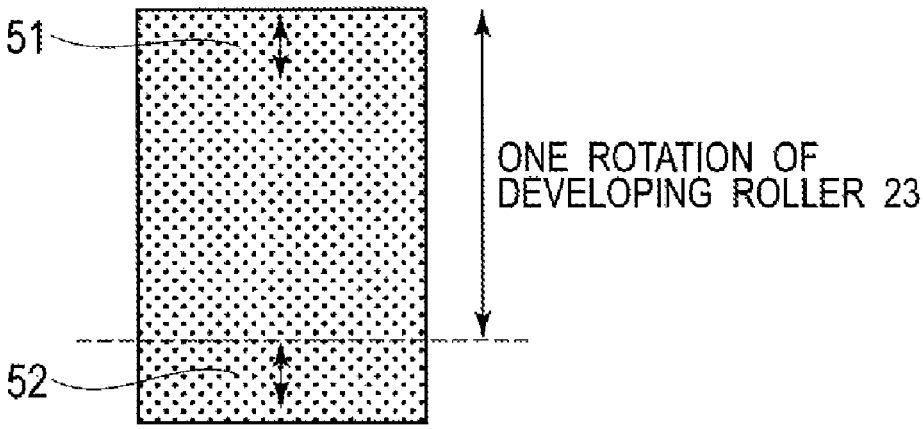

FIGS. 5A and 5B are explanatory views illustrating smear detection pattern 1 formed on image transfer belt 16.

For example, as show in FIG. 5, the smear detection pattern (serving as the density detection pattern of the developer image) is uniformly formed on image transfer belt 16 under a uniform developing condition and thus has a uniform low density. The low density is preferably equal to or less than the duty ratio (DUTY %) of 30%, since density variation is easily detected on the pattern whose duty ratio is equal or less than 30%. Regarding the duty ratio (DUTY %), the duty ratio (a print ratio) is a ratio with respect to a solid pattern, which is formed under the duty ratio of 100%, and is calculated based on an average of the number of electrostatic latent dots per printed sheet. The pattern comprises a toner image (a developer image) formed with toner (developer). The width of the smear detection pattern is designed to have more than the width where density sensor 19 detects on image transfer belt 16.

By using the smear detection pattern, the embodiment detects the first position (first density detection area 51) on the smear detection pattern, which is the leading area of the smear detection pattern, and detects the second position (second density detection area 52) on the smear detection pattern, which is located downstream from the leading area of the smear detection pattern in the transport direction of image transfer belt 16 by the length of one rotation of developing roller 23.

Note that the same developer images are formed at density detection areas 51 and 52 and are opposite to density sensor 19.

FIG. 5A illustrates smear detection pattern 1 transferred on image transfer belt 16 and having smear. First density detection area 51 is formed in the vicinity of the start point of image transfer and second density detection area 52 is formed downstream of the start point by the length of one rotation of developing roller 23. In an example of smear detection pattern 1 on the image transfer belt 16 as shown in FIG. 5A, first density detection area 51 has higher density than the second density detection area 52 due to smear.

FIG. 5B illustrates smear detection pattern 1 transferred to image transfer belt 16 and having no smear. In an example of smear detection pattern 1 on the image transfer belt 16 as shown in FIG. 5B, first density detection area 51 has the same density as second density detection area 52.

Figure 6A:
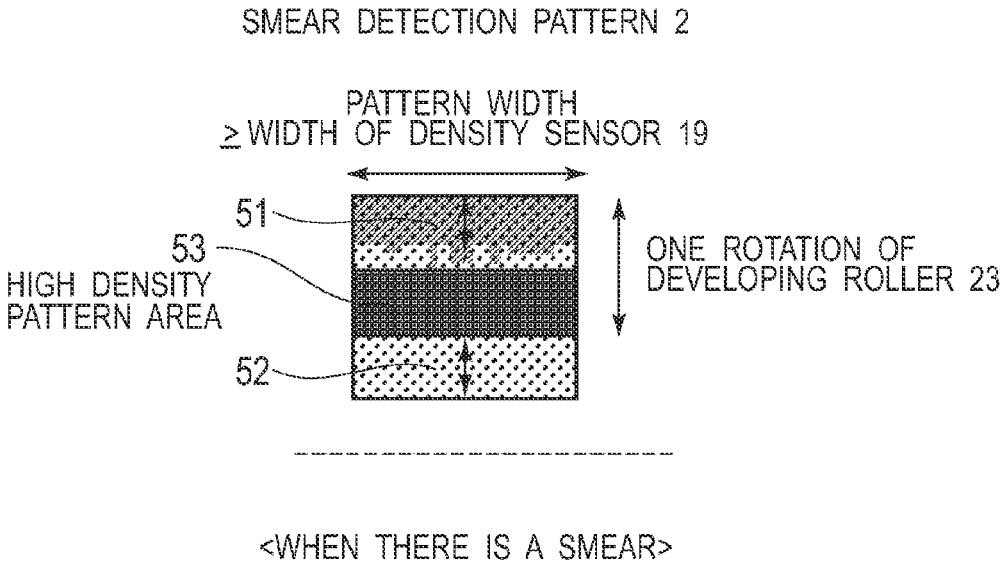
FIGS. 6A and 6B are explanatory views illustrating smear detection pattern 2.
Figure 6B:
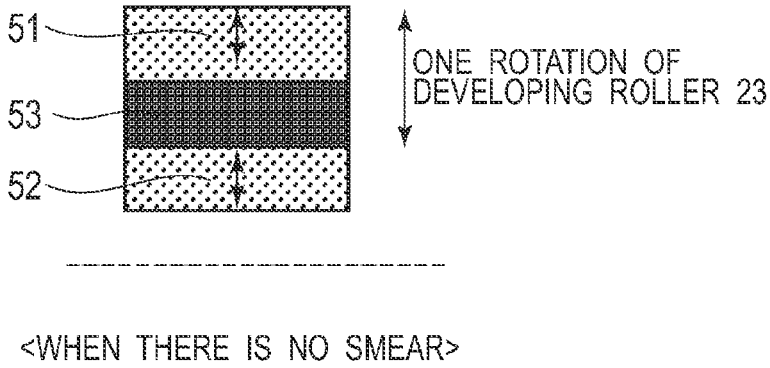

FIG. 6 is an explanatory view illustrating smear detection pattern 2 formed on image transfer belt 16. Smear detection pattern 2 has density detection area 51 and density detection area 52 which are developed under the same condition and form a low density pattern, and high density pattern area 53 between density detection area 51 and density detection area 52.

Because of the above describe configuration of smear detecting patter 2, if there is excessively charged toner, especially at a contact between developing roller 23 and toner regulating member 25, all of the excessively charged toner is discharged to high density pattern area 53 in the image transfer operation. Accordingly, smear does not occur extending from density detection area 51 to density detection area 52 such that there is no smear at density detection area 52, and thus more accurate smear detection can be achieved.

(Printing Operation of Image Forming Apparatus)

The operation of image forming apparatus 10 will be described with reference to FIGS. 1 and 2. The surface of photosensitive drum 21 is uniformly charged to an arbitrary polarity and potential by a charging device such as a charging roller 22. According to a print instruction from an external device such as a host computer or the like, image data is output from controller 40 and sent to exposure head 15, and exposure head 15 forms an electrostatic latent image corresponding to the image data on the surface of photosensitive drum 21. By rotating supplying roller 24 being in contact with developing roller 23, toner is supplied from an unillustrated toner container to developing roller 23.

Toner on developing roller 23 is triboelectrically charged by toner regulating member 25 being in contact with developing roller 23 or by the like. The thickness of the toner on developing roller 23 is determined by the pressing force of toner regulating member 25 on developing roller 23 or by the like. By applying a voltage to developing roller 23, developing roller 23 attaches toner to the electrostatic latent image on photosensitive drum 21 being in contact with developing roller 23. Then, the toner on photosensitive drum 21 is transferred onto paper sheet 11 by an electric field generated by a voltage applied to image transfer roller 31. Thereafter, the transferred toner on paper sheet 11 is fixed by fixing device 17.

The toner residual on photosensitive drum 21 is removed by cleaning unit 26 after the transfer is completed.

If the above described operation is executed without paper sheet 11 conveyed by image transfer belt 16, the toner on photosensitive drum 21 is transferred onto image transfer belt 16. After that, as image transfer belt 16 moves, the transferred toner on image transfer belt 16 is conveyed to the position opposite density sensor 19 and then to the position of an unillustrated toner removing device so as to be removed from image transfer belt 16 by the toner removing device.

(Toner Discarding Operation)

Next, the toner discarding operation will be described.

In the case where the amount of toner that is used for printing continues to be very small, most of the toner attached on developing roller 23 is rubbed at contacts between developing roller 23 and supplying roller 24, toner regulating member 25, or photosensitive drum 21 while rotating with developing roller 23 at the same place on developing roller 23 without being supplied to photosensitive drum 21, and thus may be triboelectrifically charged to an excessive potential. When such excessively charged toner is transferred to an electrostatic latent image on photosensitive drum 21, the excessively charged toner is attached to photosensitive drum 21 more than necessary, thereby smearing paper sheet 11. For this reason, the excessive charged toner is to be removed, before printing on paper sheet 11.

Upon printing on paper sheet 11 as normal, the image forming apparatus attaches toner to an electrostatic latent image on photosensitive drum 21 to form a toner image, and transfers the toner image onto paper sheet 11 by means of an electric field generated between photosensitive drum 21 and image, transfer roller 31 as described above. On the other hand, upon executing the toner discarding operation, the image forming apparatus attaches toner to an electrostatic latent image on photosensitive drum 21 to forma toner image, and does not apply the voltage to image transfer roller 31 so as not to generate the electric field between photosensitive drum 21 and image transfer roller 31. With this operation, the toner on photosensitive drum 21 remains on photosensitive drum 21 and thus all of the toner on photosensitive drum 21 is removed from photosensitive drum 21 by cleaning unit 26.

Here, the toner discarding operation will be described further in detail. The toner discarding operation discharges a predetermined amount of toner, by forming another toner image such as a toner discarding pattern (developer discarding pattern) having a higher density than the smear detection pattern and discarding the developer discarding pattern. The predetermined amount of toner to be discarded may be based on characteristics of image forming cartridge 20, image forming apparatus 10, or the like. The predetermined amount of toner to be discarded may be determined based on the density difference detected by density sensor 19. For example, to determine the predetermined amount of toner to be discarded, the toner discarding operation executes a solid printing (solid pattern) of 100% when the density difference is greater than a threshold, while the toner discarding operation executes the solid printing (solid pattern) of 70% when the density difference is not greater than the threshold.

One of the key points of the first embodiment is that the smear detection pattern is the low density pattern formed under the same development condition. When the smear detection pattern is transferred onto image transfer belt 16, image forming cartridge 20 should not be operated under an idle rotation. The idle rotation of image forming cartridge 20 means that an operation where a toner image is not formed (developed) on photosensitive drum 21 while developing roller 23 and supplying roller 24 rotate. That is to say, toner on developing roller 23 and/or supplying roller 24 are being charged during the idle rotation of image forming cartridge 20, and thereby a smear may appear in density detection area 52 of the smear detection pattern. To avoid this, the apparatus continuously forms the smear detection pattern of the toner image from density detection area 51 to density detection area 52.

Figure 7:
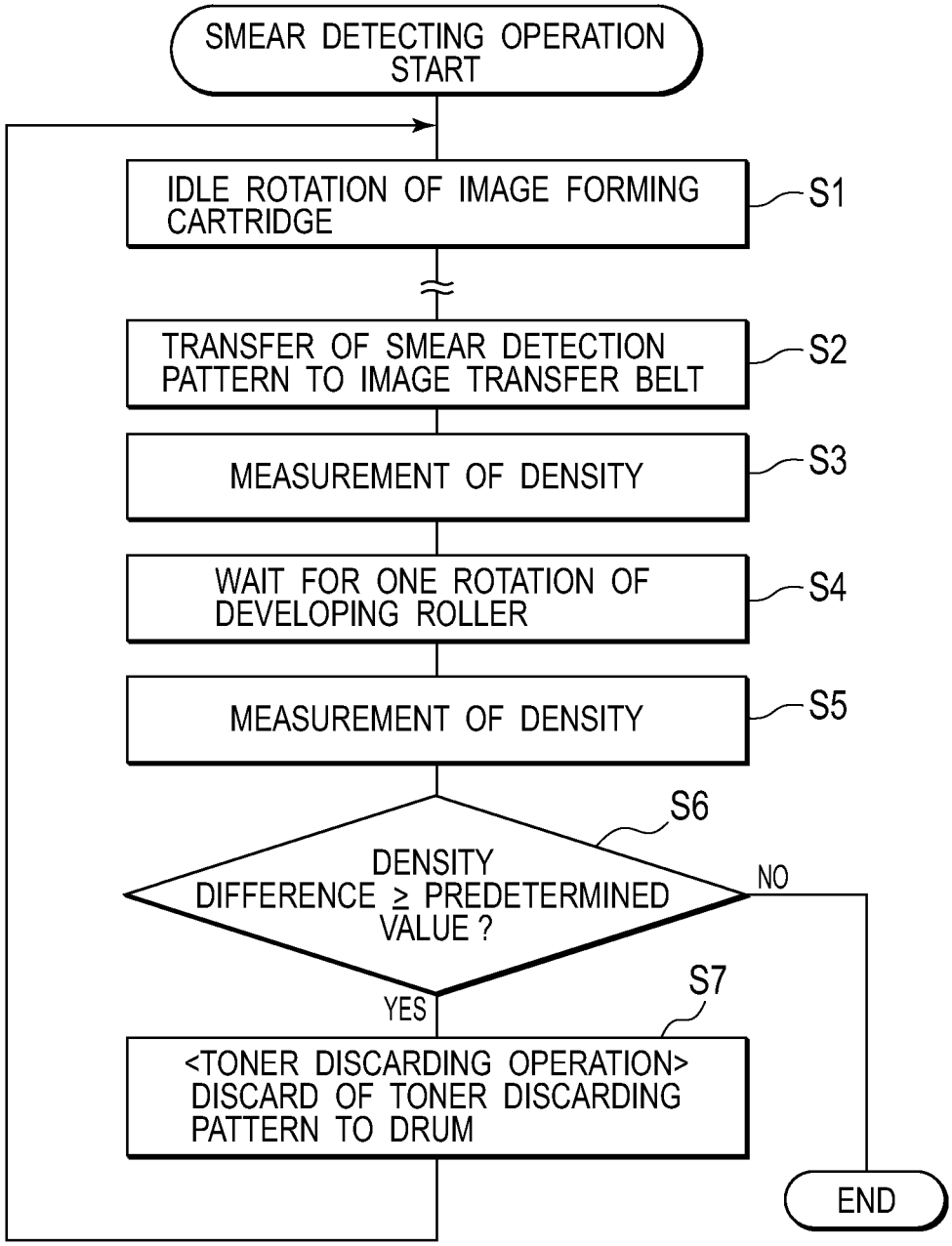
FIG. 7 is a flowchart of a smear detecting operation of image forming apparatus 10 of FIG. 1.

FIG. 7 is a flowchart of the smear detecting operation of image forming apparatus 10 of FIG. 1. First, upon instruction from controller 40, the smear detecting operation starts. In step S1, the apparatus executes the idle rotation of image forming cartridge 20. This idle rotation continues to be executed from the time when paper sheet 11 is picked up and fed from cassette 12 to conveyance path 14 to the time when paper sheet 11 is conveyed to the position of photosensitive drum 21. This idle rotation is for charging toner on developing roller 23 and supplying roller 24 to a potential equal to or close to the level for the printing.

In step S2, toner image forming unit 45 generates the smear detection pattern and controls exposure head 15 to form the smear detection pattern of toner on photosensitive drum 21. Next, the apparatus transfers the smear detection pattern from photosensitive drum 21 to image transfer belt 16 by applying the voltage to image transfer roller 31. In step S3, the apparatus rotates image transfer belt 16 with an unillustrated drive motor to convey density detection area 51 of the smear detection pattern to the position of density sensor 19. When density detection area 51 arrives at the position of density sensor 19, density detector 41 detects the density of density detection area 51.

In step S4, density detector 41 waits until the pattern passes through density sensor 19 by one rotation of developing roller 23. In step S5, when the pattern has passed through density sensor 19 by one rotation of developing roller 23, that is, when density detection area 52 arrives at the position of density sensor 19, density detector 41 detects the density of density detection area 52. In step S6, density-difference calculator 42 calculates the difference between the density of density detection area 51 and the density of density detection area 52. When the determination result of smear determiner 43 shows that the difference between the density of density detection area 51 and the density of density detection area 52 is equal to or greater than a predetermined value (YES in step S6), it is determined that a smear occurred in the smear detection pattern (that is, it is determined that toner on developing roller 23 is excessively charged), and then proceeds to step S7. Note that the predetermined value is, for example, the density difference of 0.10 between the densities measured by using a densitometer of X-Rite 500 series (made by X-Rite, Incorporated) in the first embodiment. The density is represented by $-\log_{10}$ (reflection rate) in general.

When the determination result of smear determiner 43 shows that the difference between the density of density detection area 51 and the density of density detection area 52 is less than the predetermined value (NO in step S6), it is determined that there is no smear in the smear detection pattern, and thereby the smear detecting operation ends.

When there is smear in the smear detection pattern, toner image forming unit 45 forms the toner discarding pattern in order to execute the toner discarding operation for discarding the predetermined amount of toner (step S7).

Note that the toner discarding operation is an operation exposing the toner discarding pattern, such as a solid pattern of the print duty 100% having a width corresponding to the effective width of developing roller 23 and a length corresponding to the length of one rotation of developing roller 23, on photosensitive drum 21 to form an electrostatic latent image of the toner discarding pattern, attaching toner to an electrostatic latent image of the toner discarding pattern on photosensitive drum 21 to develop the toner discarding pattern formed of toner, and then applying no voltage to image transfer roller 31 so as not to generate the electric field between photosensitive drum 21 and image transfer roller 31. With this operation, the toner discarding pattern of toner remains on photosensitive drum 21, and then all the toner discarding pattern of toner is removed by cleaning unit 26 as photosensitive drum 21 rotates.

In step S7, after discarding the predetermined amount of toner, the process proceeds back to step S1 in order to execute the smear detecting operation again, and the above operation is repeatedly executed until it is determined that no smear occurs in the smear detection pattern in step S6. Note that it is preferable to set the upper limit of the number of repeats of the loop of steps S1 through S7, in order to avoid unlimited repeating the loop in the case where, due to a reason other than smear, the density difference between density detection area 51 and density detection area 52 continues being not less than the predetermined value in step S6 of each loop.

The upper limit may be three (three times). In this case, when the difference between the density of density detection area 51 and the density of density detection area 52 is equal to or greater than the predetermined value even through the smear detection operations are continuously executed three times, the apparatus may display, on an unillustrated display or the like, a message prompting the user to check the image forming apparatus, since it is considered that an error has occurred in the image forming apparatus. Note that the upper limit is determined based on an experimental result of examining the relationship between the occurrence (nonoccurrence) of a smear on the smear detection pattern and the number of times of continuously discarding the toner discarding patterns of the first embodiment.

Effects of First Embodiment

The first embodiment detects densities of plural areas having the same density in the low density toner image pattern (a half-tone pattern) formed on image transfer belt 16, compares the densities of the plural areas with each other, determines, based on the comparison result, whether or not smear occurs in the low density toner image pattern due to an excessively charged toner, and discards the predetermined amount of toner when it is determined that there is smear on the pattern. Consequently, the first embodiment achieves an appropriate density correction.

Further, not limited to the appropriate density correction, the first embodiment detects a smear in the pattern instantaneously and reproduces an image on paper sheet having appropriate density, color, and the like without smear on the paper sheet by executing the operation of the first embodiment

Modifications of First Embodiment

In the first embodiment, when the density difference between density detection area 51 and density detection area 52 is equal to or greater than a predetermined value, it is determined that there is a smear in the smear detection pattern (that is, it is determined that toner on developing roller 23 is excessively charged).

A modification of the first embodiment has a charge level sensor configured to detect the charge level on developing roller 23 and a charge level sensor configured to detect the charge level on supplying roller 24. When the density difference detected by density sensor 19 is equal to or greater than the predetermined value, the modification detects the charge level on developing roller 23 and the charge level on supplying roller 24 by using the charge level sensors, and checks whether the difference between the detected charge level on developing roller 23 and the detected charge level on supplying roller 24 exceeds a predetermined level in order to determines whether toner on developing roller 23 is excessively charged or not.

Second Embodiment

Configuration of Second Embodiment

Figure 8:
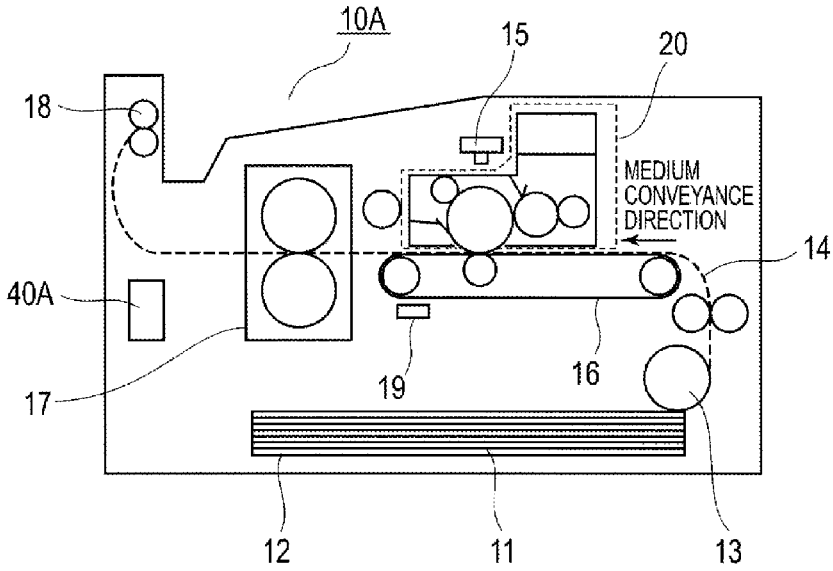
FIG. 8 is a configuration diagram of an image forming apparatus of a second embodiment of the invention.

FIG. 8 is a configuration diagram of an image forming apparatus of a second embodiment of the invention. In FIG. 8, the same constituents as in FIG. 1 of the first embodiment are designated by the same reference numerals as in FIG. 1 of the first embodiment.

Image forming apparatus 10A of the second embodiment has substantially the same configuration as image forming apparatus 10 of the first embodiment but has controller 40A as a substitute for controller 40 of the first embodiment.

Figure 9:
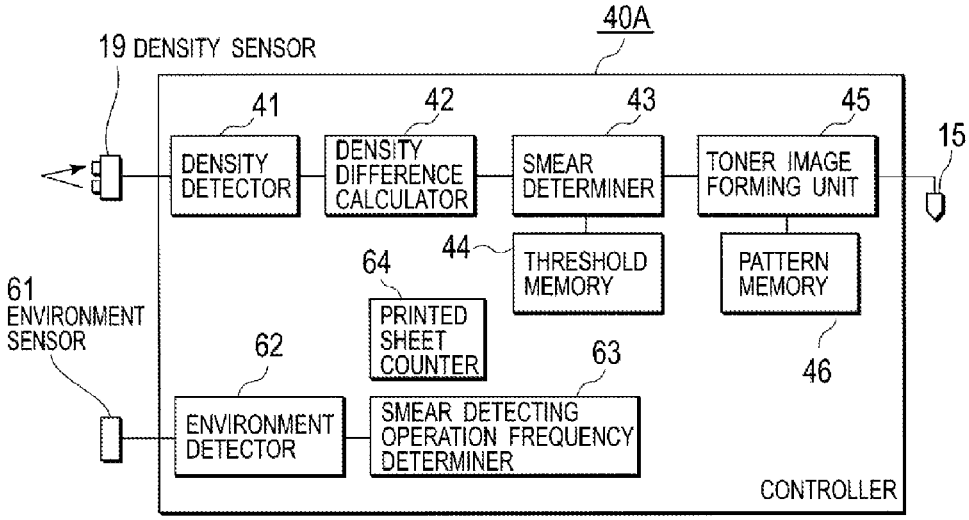
FIG. 9 is a functional block diagram of controller 40A shown in FIG. 8 according to the second embodiment of the invention.

FIG. 9 is a functional block diagram of controller 40A shown in FIG. 8 according to the second embodiment of the invention. In FIG. 9, the same constituents as in FIG. 3 of the first embodiment are designated by the same reference numerals as in FIG. 3 of the first embodiment.

In addition to the configuration of the first embodiment, the second embodiment has environment sensor 61 (serving as an environment sensing unit) configured to detect temperature and humidity and provided outside controller 40A of the second embodiment. Controller 40A of the second embodiment has: environment detector 62 configured to detect a voltage value which is converted from information of the temperature and the humidity detected by environmental sensor 61; smear detecting operation frequency determiner 63 (serving as an operation frequency determiner) configured to determine, based on the detection result of environmental detector 62, how often the apparatus should execute the smear detecting operation; and printed sheet counter 64 configured to provide an indication of frequency of the smear detecting operation.

Operation of Second Embodiment

Figure 10:
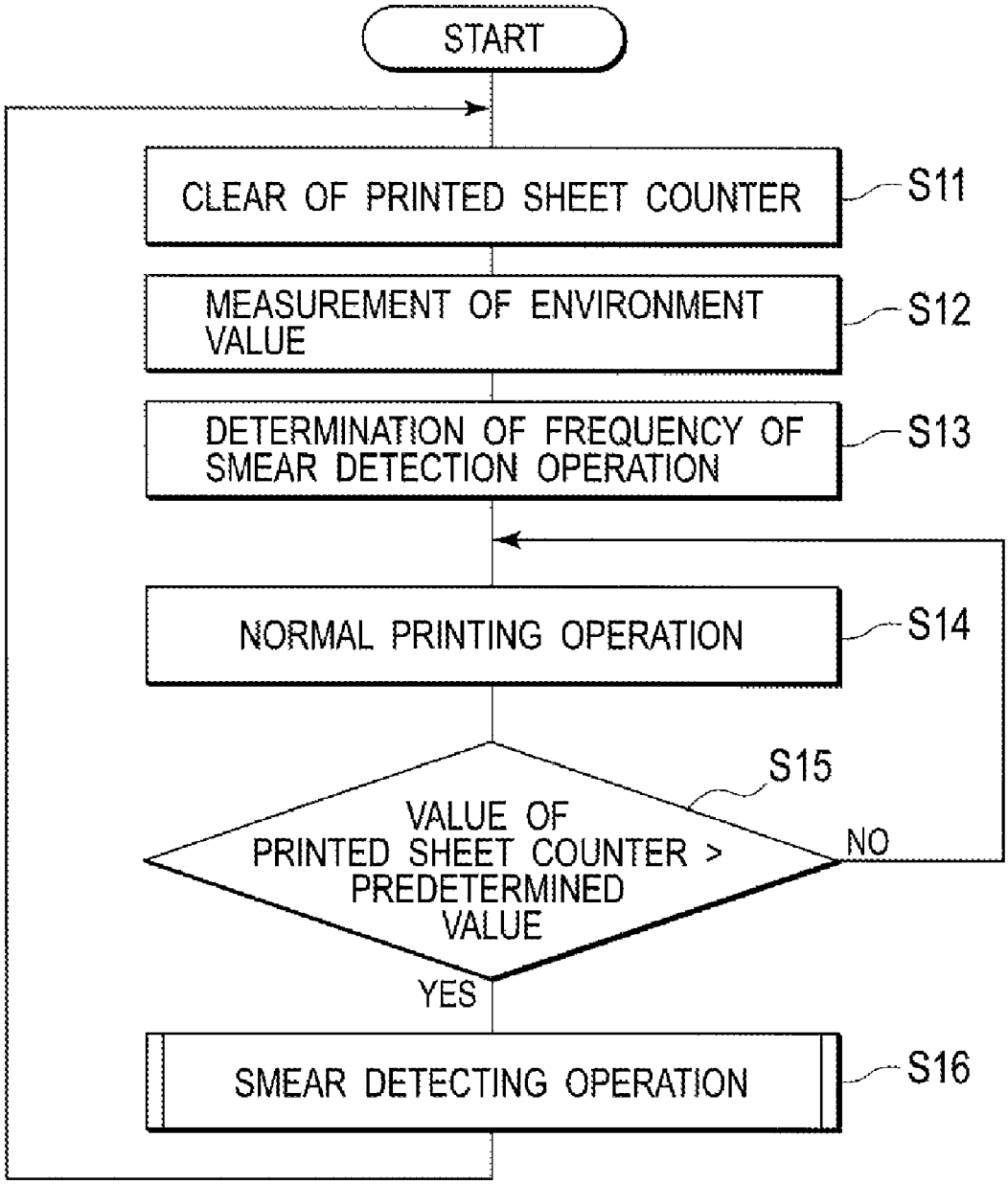
FIG. 10 is a flowchart of a smear detecting operation frequency determination process of image forming apparatus 10A of FIG. 8.

FIG. 10 is a flowchart of the smear detecting operation frequency determination process of image forming apparatus 10A of FIG. 8.

As described in the first embodiment, smear occurs due to excessively charged toner in printing. Regarding the speed of toner charging, the lower the amount of water vapor in the air (that is, the lower the humidity), the quicker the toner is charged, because the lower the humidity, the more difficult it is for electric charge on the toner to discharge. Regarding the temperature, the higher the temperature, the greater the radius of developing roller 23 and the radius of supplying roller 24 and the greater the press-contact area between the rollers becomes. Therefore, the higher the temperature, the easier the toner is triboelectrifically charged and the higher the charging rate becomes.

For this reason, it is considered that it would be better that the apparatus executes the smear detecting operation more frequently in a low-humidity and high-temperature condition where smear occurs more often, whereas the apparatus executes the smear detecting operation less frequently in a high-humidity and low-temperature condition. However, in the real operating condition of image forming apparatus 10A, the toner charge level depends almost only on the humidity. Accordingly, the second embodiment changes the frequency of the smear detecting operation based on value of the humidity. The smear detecting operation frequency determination process according to the second embodiment is described below with reference to the flowchart of FIG. 10.

First, upon instruction from controller 40A, the process starts. In step S11, as an initial setting, the count value of printed sheet counter 64 is reset to zero. In step S12, for detecting an environmental value (degree of humidity), environment detector 62 reads the output of environment sensor 61 and outputs the environmental value (the degree of humidity). In step S13, smear detecting operation frequency determiner 63 receives the output degree of humidity and determines, based on the degree of humidity, the frequency of the smear detecting operation. Here, the frequency means time intervals where the smear detecting operation is executed. The frequency may be determined based on the number of printed sheets, the length of the operation time, or the like in the invention. In the second embodiment, the frequency is determined based on the number of printed sheets, that is, the second embodiment executes the smear detecting operation every time when the number of printed sheets reaches a threshold printed sheet number (a threshold count value). For example, the threshold count value is determined (calculated) based on the following, formula, where the humidity is expressed by H (% RH). Note that RH represents the relative humidity.

$$\text{Threshold count value(threshold printed sheet number)} = 20 \times H(\%\ RH) + 600.$$

According to the above formula for determining the threshold count value, for example, in a low humidity condition where the relative humidity (RH) is 20%, the smear detecting operation is executed every 1000 printed sheets, and in a high humidity where the relative humidity (RH) is 80%, the smear detecting operation is executed every 2200 printed sheets.

After the threshold count value is determined (set), the process proceeds to step S14. In step S14, the apparatus executes the normal printing operation while printed sheet counter 64 counts the number of printed sheets. In step S15, when the count value of printed sheet counter 64 reaches the threshold count value (the threshold printed sheet number), the process proceeds to step S16 so as to execute the smear detecting operation.

Like the first embodiment, the smear detecting operation of the second embodiment, executes step S1 (the idle rotation process) to process the idle rotation of image forming cartridge 20, step S2 (the image transfer operation) to transfer the smear detection pattern onto image transfer belt 16, step S3 (the first density measurement process) to measure the density of density detection area 51, step S4 (the wait process) to wait until the developing roller 23 rotates one cycle, step S5 (the second density measurement process) to measure the density of density detection area 52, step S6 (the density difference calculation process) to calculate the difference between the detected density of density detection area 51 and the detected density of density detection area 52, and step S7 (toner discarding process) to discard toner.

On the other hand, when the count value of printed sheet counter 74 does not reach the threshold count value (the threshold printed sheet number), the process proceeds back to step S14 to repeat the normal printing process. In step S16, the smear detecting operation is executed, and after that, the process proceeds back to step 1 to clear the counted value of printed sheet counter 64 so as to repeat steps S11 to S16.

Effects of Second Embodiment

The second embodiment has the following effect in addition to the effects of the first embodiment.

In the second embodiment, image forming apparatus 10A has environment sensor 61 and is capable of changing the frequency of executing the smear detecting operation based on the humidity and temperature. The second embodiment eliminates an unnecessary smear detection operation and an unnecessary toner discarding operation, thereby toner is not discarded more than needed.

Third Embodiment

Configuration of Third Embodiment

Figure 11:
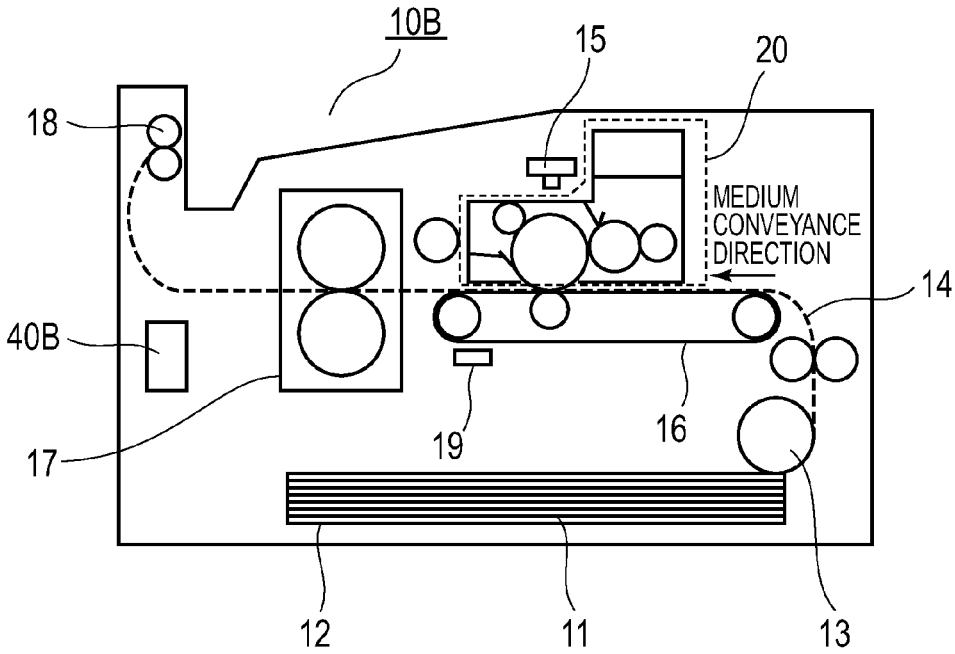
FIG. 11 is a configuration diagram of an image forming apparatus of a third embodiment of the invention.

FIG. 11 is a configuration diagram of an image forming apparatus of a third embodiment of the invention. In FIG. 11, the same constituents as in FIG. 1 of the first embodiment are designated by the same reference numerals as in FIG. 1 of the first embodiment.

Image forming apparatus 10B of the third embodiment has substantially the same configuration as image forming apparatus 10 of the first embodiment but has a configuration different from the first embodiment, that is, controller 40 of the first embodiment is replaced with controller 40B of the third embodiment.

Figure 12:
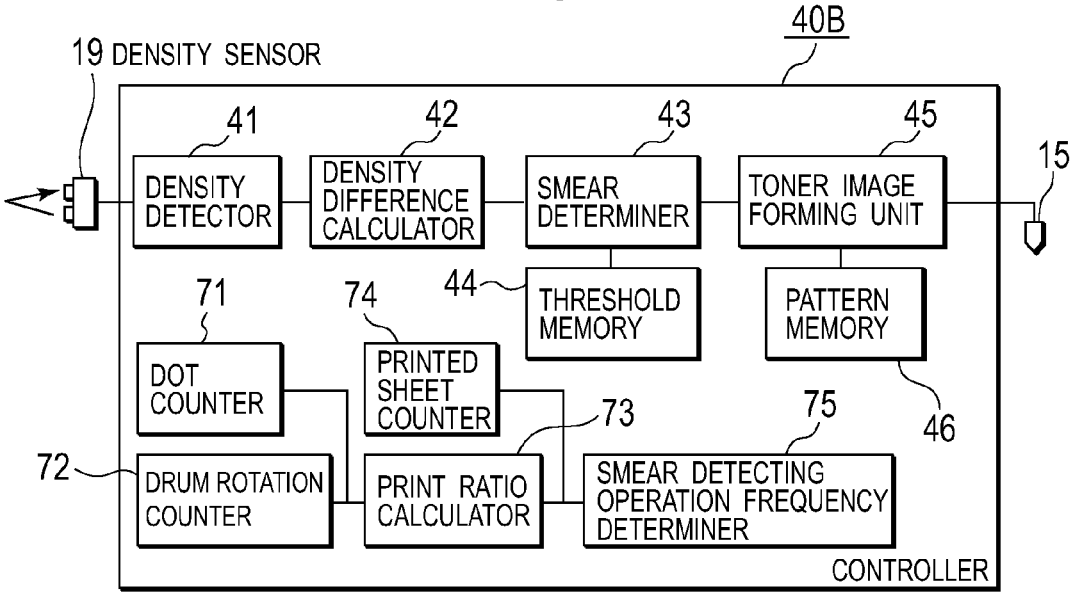
FIG. 12 is a functional block diagram of controller 40 B shown in FIG. 11 according to the third embodiment of the invention.

FIG. 12 is a functional block diagram of controller 40B of FIG. 11 according to the third embodiment of the invention. In FIG. 12, the same constituents as in FIG. 3 of the first embodiment are designated by the same reference numerals.

The configuration of controller 40B of the third embodiment has a smear detecting operation frequency determining unit in addition to that of the first embodiment. The smear detecting operation frequency determining unit includes: dot counter 71 serving as a dot number counter configured to count the number of dots of the electrostatic latent image; drum rotation counter 72 serving as a developer image carrier movement amount detector configured to detect a movement amount (or a rotation amount) of photosensitive drum 21 during the printing operation, that is, configured to count the number of rotations of photosensitive drum 21; print ratio calculator 73 configured to calculate a print ratio (or a print duty), which is the average of the number of electrostatic latent image dots per printed sheet, based on count values of dot counter 71 and drum rotation counter 72; printed sheet counter 74 or a printed sheet counting unit configured to count the number of printed sheets; and smear detecting operation frequency determiner 75 (serving as an operation frequency determiner) configured to determine, based on a count value of printed sheet counter 74 and the print ratio calculated by the print ratio calculator 73, how often the smear detecting operation should be executed.

Operation of Third Embodiment

Figure 13:
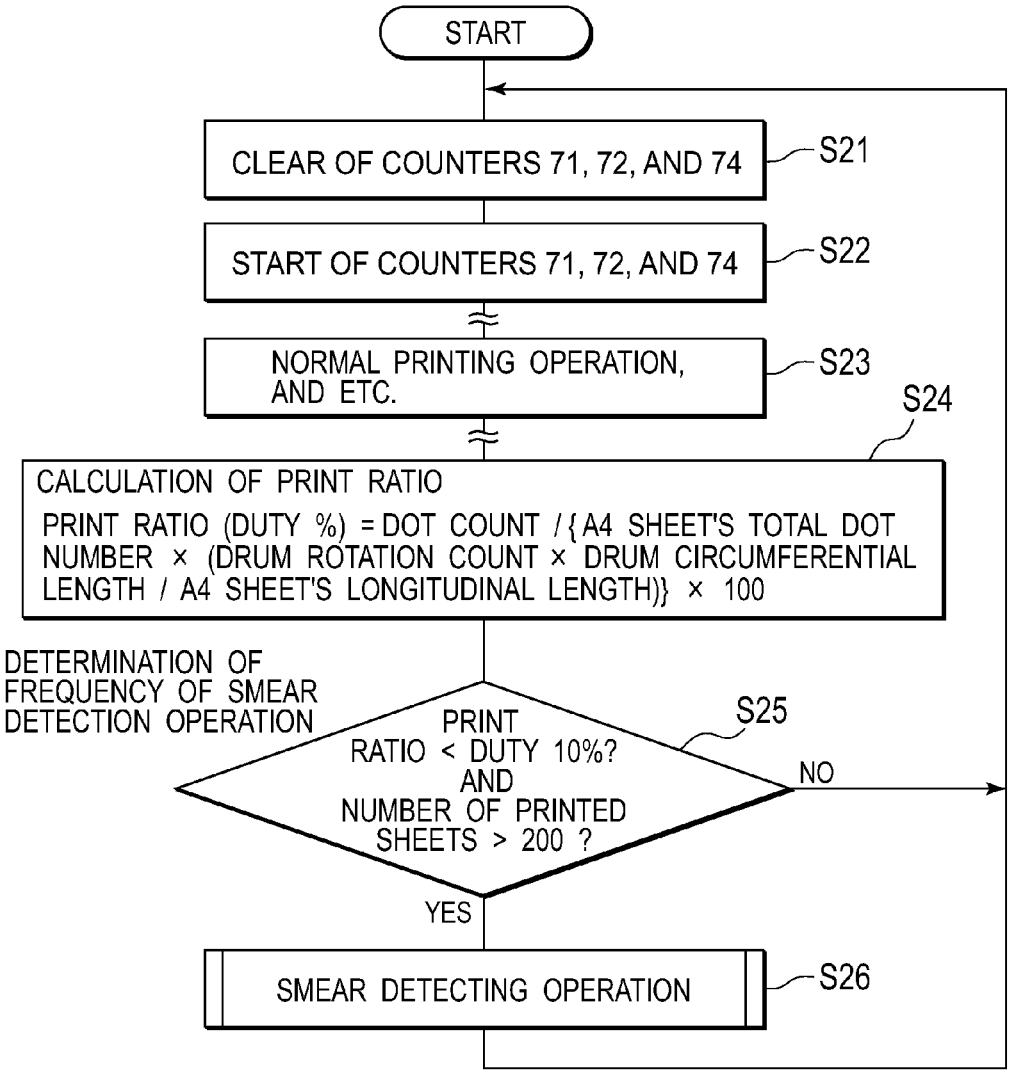
FIG. 13 is a flowchart of a smear detecting operation frequency determination process of image forming apparatus 10B of FIG. 11.

FIG. 13 is a flowchart of the smear detecting operation frequency determination process of image forming apparatus 10B of FIG. 11.

As described in the first embodiment, in the case where the amount of toner that is used for printing has been very small for a while, that is, where low density printing has continued for a while, toner attached on developing roller 23 has rotated with attached at the same position on developing roller 23 without being supplied from developing roller 23, and thus has been rubbed so as to be triboelectrifically charged. Accordingly, the toner on developing roller 23 may be excessively charged and may be the cause of smear on paper sheet (s) 11. On the other hand, in the case of high density printing, toner on developing roller 23 is continually supplied from developer roller 23 for printing before the toner can become excessively charged on developing roller 23, and thus smear rarely occurs on paper sheet(s) 11.

Considering this, the third embodiment has a configuration that determines the number of printed sheets and the print ratio during the latest predetermined time interval (for example, one hour) and changes the frequency of executing the smear detecting operation based on the number of the printed sheets and the print ratio.

Upon instruction of controller 40B, the smear detecting operation frequency determination process starts. In step S21, as an initial setting, the apparatus clears count values of dot counter 71, drum rotation counter 72, and printed sheet counter 74 to zero. In step S22, dot counter 71, drum rotation counter 72 and printed sheet counter 74 start to count. In step S23, the dot count (the counted number of dots), the drum rotation count (the counted number of rotations of the drum), and the printed sheet count (the counted number of printed sheets) that have accumulated for all operations including the normal printing operation, a warm-up operation, and the like in a predetermined time are obtained (calculated).

In step S24, print ratio calculator 73 calculates the print ratio based on the dot count and the drum rotation count that are obtained in step S23. The print ratio is simply expressed by the following formula, where a solid pattern of the entire print area of A4 size paper sheet corresponds to DUTY 100%.

$$\text{The print ratio[DUTY \%]}=DC/\{DNCA4\times(DMC\times DML/LA4)\}\times 100$$

DC: dot count (the number of counted dots)

DNCA4: total dot number of A4 sheet (the maximum number of dots of A4 sheet)

DMC: drum rotation count (the number of counted drum rotation)

DML: drum circumferential length

LA4: longitudinal length of A4 sheet

In step S25, smear detecting operation frequency determiner 75 determines whether or not to execute the smear detecting operation, with reference to the calculated print ratio and the calculated number of printed sheets. For example, when the average print ratio per hour is less than the duty of 10% and the number of printed sheets exceeds 200, the process proceeds to step S26 to execute the smear detecting operation.

On the other hand, if smear detecting operation frequency determiner 75 determines not to execute the smear detecting operation (no in step S25), the process proceeds back to step S21 without executing the smear detecting operation. After that, the process of step S21 to S26 is repeated.

Note that in the third embodiment, step S25 determines whether or not to execute the smear detecting operation of step S26 with reference to the thresholds (10% and 200) per hour. However, the image forming apparatus according to the invention may sequentially change the predetermined time interval or the thresholds used for step S25 based on the number of paper sheets that are continuously printed under a low duty (low print ratio) so that the number (the frequency) of executing the smear detecting operation can be increased corresponding to the condition where smear is likely to occur.

Effects of Third Embodiment

The third embodiment accomplishes the following effects in addition to the effects of the first embodiment. The print ratio is calculated based on the number of dots of the electrostatic latent image counted by dot counter 71 and the number of rotations of the drum counted by drum rotation counter 72. The frequency of executing the smear detecting operation is changed corresponding to the value of the print ratio and the number of printed sheets. Therefore, the third embodiment eliminates an unnecessary smear detecting operation and an unnecessary toner discharging operation, thereby preventing discarding toner more than needed.

Other Modifications of First to Third Embodiment

The invention is not limited to the above first to third embodiments and includes various applications and modifications. Examples of the applications and modifications include, for example, the followings (a) to (e):

(a) Image forming apparatus 10, 10A, and 10B may be not only a printer but also a copier, a facsimile machine, a multifunctional periphery (MFP), or the like.

(b) Although a print medium is paper sheet 11 in the above embodiments, the print medium is not limited to paper sheet 11 but includes other print media such as a film or the like in the invention.

(c) In the above embodiments, the smear detection pattern is formed on image transfer belt 16 and the density of the smear detection pattern is detected by density sensor 19, which is disposed beneath image transfer belt 16. However, the invention may form the smear detection pattern on photosensitive drum 21 and detect the density of the smear detection pattern by a density sensor that is disposed in image forming cartridge 20.

(d) In the above embodiments, the smear detection pattern includes the first position and the second position which are on the upstream side and on the downstream side in the transport direction of the image transfer belt. However, for example, in the case of continuously forming a pattern having an uneven distribution of density in the width direction of the image transfer belt (that is, a direction orthogonal to the transport direction of the image transfer belt), the charge level of toner on developing roller 23 may have an uneven distribution in the width direction of the image transfer belt and thus the density of a printed image on paper sheet 11 may have an uneven distribution in the width direction of the image transfer belt. In order to detect this, modification (d) is provided with density sensor 19 at each widthwise side of image transfer belt and detects the density of one widthwise side (a first position) of the smear detecting pattern and the density of the other widthwise side (a second position) of the smear detecting pattern by using density sensor 19 at each widthwise side, calculates a difference between the density of the first position at one widthwise end and the density of the second position at the other widthwise end, and then determines the charge level of toner (developer), like the first embodiment.

(e) The shape of the toner discarding pattern, the amount of toner to be discarded, and the like are not limited to the above embodiments and the invention includes various modifications and changes of those.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus comprising:

a developer image carrier movably disposed;

a developer image forming device configured to form a developer image;

a detector disposed facing the developer image carrier and configured to detect a density of the developer image attached on the developer image carrier;

a controller configured to control an operation of forming the developer image by the developer image forming device;

an image forming unit configured to control the developer image forming device to form a density detection pattern comprised of the developer image, the density detection pattern including the same developer image at at least a first point and a second point with a predetermined distance between the first point and the second point;

a density detector configured to obtain a first point density and a second point density of the density detection pattern; and a calculator configured to calculate a difference between the first point density and the second point density of the density detection pattern.

2. The image forming apparatus according to claim 1, wherein the developer image carrier is an image transfer belt.

3. The image forming apparatus according to claim 1, wherein the developer image carrier is a photosensitive drum.

4. The image forming apparatus according to claim 1, wherein the second point is provided downstream of the first point in the movement direction of the developer image carrier.

5. The image forming apparatus according to claim 1, wherein the developer image forming device includes a developing unit, the developing unit has a circumference on which a developer layer is formed, and the predetermined distance is more than one length of the circumference of the developing unit.

6. The image forming apparatus according to claim 1, wherein the detector is a reflective optical sensor.

7. The image forming apparatus according to claim 1, wherein the controller determines whether a developer charge level is normal or not when the difference between the first point density and the second point density is equal to or greater than a predetermined amount.

8. The image forming apparatus according to claim 1, wherein the controller controls the developer image forming device to form a developer discarding pattern comprised of the developer image on the developer image carrier when the controller determines the developer charge level is not normal.

9. The image forming apparatus according to claim 8, wherein the developer discarding pattern density is higher than the first point density and the second point density of the density detection pattern.

10. The image forming apparatus according to claim 8, wherein the developer discarding pattern is determined based on the difference between the first point density and the second point density of the density detection pattern.

11. The image forming apparatus according to claim 1, wherein the controller repeats the following operations (a) to (d) until it is determined that the difference between the first point density and the second point density of the density detection pattern is less than a predetermined amount:

(a) a formation of the density detection pattern having the first point and the second point by using the developer image forming device;

(b) a detection of the first point density and the second point density of the density detection pattern by using the detector;

(c) a calculation of the difference between the first point density and the second point density by using the calculator; and (d) a formation of a developer discarding pattern on the developer image carrier by using the image forming unit.

12. The image forming apparatus according to claim 6, wherein the reflective optical sensor is configured to optically detect the density of the developer image based on an amount of light irradiated to the developer image and an amount of light reflected from the developer image.

13. The image forming apparatus, according to claim 1, wherein the formation of the density detection pattern is determined based on the difference between the first point density and the second point density of the density detection pattern.

14. The image forming apparatus according to claim 1, further comprising:

an environment detector configured to detect temperature and humidity, wherein the controller changes, based on the detection result of the environment detector, a timing of determining the developer charge level.

15. The image forming apparatus according to claim 7, further comprising:

a smear detecting operation frequency determiner configured to determine a timing of determining the developer charge level, based on the number of printed media per unit time and a print ratio which is an average print density per unit time.

16. The image forming apparatus according to claim 15, further comprising:

a dot number counter configured to count the number of dots of the developer image formed by the developer image forming device;

a developer image carrier movement amount detector configured to detect a movement amount of the developer image carrier during a print operation;

a printed media counter configured to count the number of printed media; and a print ratio calculator configured to calculate the print ratio based on an average of the number of electrostatic latent image dots per unit of printed media.

17. The image forming apparatus according to claim 1, wherein the density detection pattern at the first point and the second point is a half-tone pattern.

18. The image forming apparatus according to claim 1, wherein the density detection pattern continuously extends from the first point to the second point.

19. The image forming apparatus according to claim 1, wherein the developer image is made of toner.

20. The image forming apparatus according to claim 1, further comprising a smear determiner configured to determine whether or not there is a smear in the smear detection pattern formed by the developer image forming device, based on the density difference calculated by the calculator, wherein the smear determiner determines that there is a smear when the density difference is equal to or more than a predetermined value and determines that there is no smear when the density difference is less than the predetermined value.

* * * * *